US012116658B2

(12) United States Patent
Zheng et al.

(10) Patent No.: US 12,116,658 B2
(45) Date of Patent: Oct. 15, 2024

(54) HOT FORMING METHOD AND DEVICE FOR LARGE-SIZE AIRCRAFT THIN-WALLED PART OF HIGH-STRENGTH ALUMINUM ALLOY

(71) Applicant: Dalian University of Technology, Dalian (CN)

(72) Inventors: Kailun Zheng, Dalian (CN); Zongren He, Dalian (CN)

(73) Assignee: Dalian University of Technology, Dalian (CN)

( * ) Notice: Subject to any disclaimer, the term of this patent is extended or adjusted under 35 U.S.C. 154(b) by 3 days.

(21) Appl. No.: 17/862,769

(22) Filed: Jul. 12, 2022

(65) Prior Publication Data

US 2023/0203633 A1 Jun. 29, 2023

(30) Foreign Application Priority Data

Dec. 24, 2021 (CN) ..... 202111601897.X

(51) Int. Cl.
*C22F 1/04* (2006.01)
*B21D 22/02* (2006.01)
*C22F 1/00* (2006.01)

(52) U.S. Cl.
CPC ..... *C22F 1/04* (2013.01); *B21D 22/022* (2013.01); *C22F 1/002* (2013.01)

(58) Field of Classification Search
CPC ..... C22F 1/04; C22F 1/002; B21D 22/022
See application file for complete search history.

(56) References Cited

U.S. PATENT DOCUMENTS

2004/0226333 A1* 11/2004 Kato ..... B21D 22/16 72/68
2012/0152416 A1* 6/2012 Foster ..... C22F 1/10 148/695
2015/0202680 A1* 7/2015 Sato ..... G06F 1/181 72/342.2

FOREIGN PATENT DOCUMENTS

WO WO-2014068493 A1 * 5/2014 ..... C21D 1/673
WO WO-2015188549 A1 * 12/2015 ..... B23P 15/00

* cited by examiner

*Primary Examiner* — Nicholas A Wang
*Assistant Examiner* — Maxwell Xavier Duffy
(74) *Attorney, Agent, or Firm* — Westman, Champlin & Koehler, P.A.

(57) ABSTRACT

Solution heat treatment is performed on a blank to dissolve initial coarse secondary phases, to obtain a uniform solid solution microstructure. The blank subjected to the solution heat treatment is transferred into the temperature-controllable forming die to be stamped and quenched. During forming, the temperature and the pressure are further maintained for a period of time. The temperature of the forming die is adjusted to a second-step aging temperature for the second-step aging treatment. In a two-step aging temperature range, stress relaxation occurs while strengthening precipitates are rapidly precipitated, thereby improving strength and dimensional accuracy of the formed part. On the premise of ensuring quality of the formed part, employing stepped aging treatment shortens the aging cycle and reduces energy consumption in the production and manufacturing process.

4 Claims, 6 Drawing Sheets a)Embodiment 3 b) Embodiment 4

HOT FORMING METHOD AND DEVICE FOR LARGE-SIZE AIRCRAFT THIN-WALLED PART OF HIGH-STRENGTH ALUMINUM ALLOY

CROSS REFERENCE TO RELATED APPLICATION

This patent application claims the benefit and priority of Chinese Patent Application 202111601897.X filed on Dec. 24, 2021, the disclosure of which is incorporated by reference herein in its entirety as part of the present application.

TECHNICAL FIELD

The present disclosure relates to the technical field of forming sheet metals, and particularly a hot forming method and device for a large-size aircraft thin-walled part of high-strength aluminum alloy.

BACKGROUND ART

Large thin-walled integral parts of aluminum alloys are key structures for realizing light weight and high reliability of new generation large aircrafts, such as the engine lips, hoods and hatch doors. These parts have the features of large scale, thin thickness, high performance requirements on rigidity and accuracy. Furthermore, the aluminum alloys for aircraft applications are highly quench sensitive requiring stringent heat treatment. The challenges of forming and manufacturing the aircraft aluminum alloy lie in that: 1) large size: the large-size integral thin-walled parts of high-strength aluminum alloys of new generation vehicles normally have a dominant dimension greater than 3 m (lip), an ultra-thin wall thickness of less than 2 mm (hatch door), and a small feature of less than 5 mm (hood); 2) high quenching sensitivity, such as 2*xxx* series aluminum alloy for the aircraft parts, and extremely complex microstructure evolution of the high-strength aluminum alloy. Performance and accuracy need to be guaranteed in a single forming. At present, existing conventional forming technologies mainly include cold stamping-welding of segments, hydro-mechanical deep drawing forming, superplastic forming, hot-stamping forming and the like, all of which cannot be used for forming the high-strength aluminum alloy thin-walled part with features mentioned above, i.e. large-size and complex shape.

In the traditional cold-stamping-welding of segments, segmented multiple parts are formed by cold stamping process and then are welded. This method is difficult to be used for high-strength aluminum alloy. If the T6 conditioned aluminum alloy is used for cold forming, this material has poor ductility and prone to splitting during forming; and furthermore, the formed part has large springbacks, it is also difficult for the plurality of formed parts to be welded together, and forced assembling generates welding residual stress, thereby leading to poor in-service reliability. If an annealed aluminum alloy is used for cold forming, the aluminum alloy needs to be subjected to solution heat aging treatment to improve the strength after being formed and welded, which arises shape distortion of the formed sheet metal parts after solution quenching, and thus cannot meet the use requirements.

In the traditional hydro-mechanical deep drawing process, the liquid media is used instead of a rigid female die; the blank is formed according to the die cavity profile by the pressure action of the liquid medium to achieve forming of the part. The material needs to be formed in an annealing state by the hydro-mechanical deep drawing at room-temperature, and the formed material is subjected to subsequent heat treatment for improving the strength, which could cause shape distortion, leading to that the accuracy is difficult to be guaranteed. Using the warm hydro-mechanical deep drawing, the forming temperature depends on the liquid medium, thus it is difficult to ensure that the material deforms at the optimum temperature of forming. Furthermore, the die and the equipment for the hydro-mechanical deep drawing are complex and low in production efficiency.

The super-plastic forming technology is a forming technology which forms sheet metals using the super-plasticity (the metal has exceptionally excellent extensibility under certain specific conditions) of the metal material to obtain various required shapes of parts. However, the traditional super-plastic forming technology has the double disadvantages of serious thinning (more than 30%) and performance weakening (more than 10%), and is also limited to fine crystal material and equipment size; thus the resulted manufacturing cost is high and production is low, which constrains its application to manufacture large size components.

By employing the principle of hot forming of metals, the hot stamping process may perform quenching heat treatment on the sheet material during forming to obtain supersaturated solid solution, and then the material strength is improved by means of subsequent artificial aging. However, the method has the following main drawbacks. (1) The aging time of the T6 aluminum alloy exceeds 10 hours, the manufacture of large-size component causes huge energy consumption and long leading time of manufacture, which cannot meet urgent needs of high efficiency and low cost in the aircraft industry. (2) The non-isothermal deformation component subjected to high heat transfer is non-uniform in both deformation and strength performance after aging, and as the large-displacement during the deep drawing of the component is prone to experience splitting due to insufficient hardening, the requirements on the friction performance of the die is stringent. The stability of mass production is difficult to guarantee, and the rejection rate is high. (3) The springback is serious under a large-size macro domain, resulting in that the dimensional accuracy of the component and the formed component cannot meet the requirements of subsequent machining and equipment.

In conclusion, the existing forming methods cannot meet the forming requirements of the large-size high-strength aluminum alloy thin-walled parts with complex shapes in the aircraft field.

Therefore, how to solve the manufacturing problem of complex structure-accuracy-performance coupling of the high-strength aluminum alloy complex thin-walled component in the prior art has become a challenge urgent to be solved by those skilled in the art.

SUMMARY

An objective of the present disclosure is to provide a hot forming method and device for a large-size aircraft thin-walled part of high-strength aluminum alloy to solve the problems in the prior art, thereby reducing energy consumption for part forming, and improving accuracy of the part forming.

To achieve the above objective, the present disclosure provides a hot forming method for the large-size aircraft thin-walled part of high-strength aluminum alloy, including the following steps:

solution heat treatment step, configured for performing solution heat treatment on a blank;

forming and in-die quenching step, configured for transferring the blank subjected to the solution heat treatment into a forming die with a temperature of T1, gradually forming the blank during closing of the forming die, and quenching in the forming die after forming of the blank;

first-step aging step, configured for maintaining a formed part at the temperature T1 for time t1 after the blank is formed, wherein the formed part is subjected to a first-step aging treatment in the forming die; and second-step aging step, cooling a temperature of the forming die to a temperature T2, and further performing a second-step aging treatment for time t2.

In some embodiments, in the solution heat treatment step, a temperature for the solution heat treatment on the blank is 500° C.-550° C., and time for the solution heat treatment is less than 50 min.

In some embodiments, in the forming and increasing die-clamping force step, time for transferring the blank subjected to the solution heat treatment into the forming die is 3 seconds to 30 seconds, and the temperature T1 is in a range of 180° C. to 270° C.

In some embodiments, in the first-step aging step, the time t1 is 0 minutes to 30 minutes.

In some embodiments, in the second-step aging step, the temperature T2 of the forming die is 150° C.-180° C., and the time t2 for the second-step aging treatment is 1 hour to 6 hours.

In some embodiments, prior to the solution heat treatment step, the blank is an aluminum alloy blank to be subjected to heat treatment, and the blank is in a T state, an H state, or an O state.

A hot forming device for a large-size aircraft thin-walled part of high-strength aluminum alloy is provided by the present disclosure, including:

an environment heating furnace, configured for performing solution heat treatment on a blank;

a forming die, including an upper die, a lower die, and a blank holder, where the blank is compressed firmly when the blank holder is located on the lower die, and the blank is formed when the upper die is matched with the lower die;

a temperature control unit, connected to the forming die and configured to control a temperature of the forming die; and a die-clamping force control unit, connected to the forming die and configured to control a pressure after the upper die and the lower die are closed.

In some embodiments, the forming die further includes a sliding block and a platform; the lower die is arranged at a top of the platform, the sliding block is arranged in a slidable mode above the top of the platform, the upper die is connected to the sliding block, and insulating panels are respectively arranged between the sliding block and the upper die, and between the lower die and the platform.

In some embodiments, the temperature control unit includes a heating element and a cooling channel; the heating element is arranged in the upper die and the lower die, the cooling channel is formed in the platform, and the cooling channel is communicated with an external cooling medium; the die-clamping force control unit includes a gas-liquid pressure cylinder and a pressure control valve which are connected, the gas-liquid pressure cylinder is connected to and increase pressure on the upper die.

Compared with the prior art, the present disclosure has the following technical effects. In the hot forming method for the large-size aircraft thin-walled part of high-strength aluminum alloy, the blank is first subjected to solution heat treatment to dissolve coarse secondary phases in an initial microstructure to obtain a uniform solid solution microstructure; the blank subjected to the solution heat treatment is then transferred into the temperature-controllable forming die, the forming die is closed, the die-clamping force of the forming die is increased and maintained for a period of time. The temperature of the forming die is adjusted to a second-step aging temperature for the second-step aging treatment in which the temperature and the pressure is maintained. In the two-step aging temperature range, the stress relaxation occurs while strengthening phases are rapidly precipitated, thereby improving the strength and dimensional accuracy of the formed part. In accordance with the hot forming method for the large-size aircraft thin-walled part of high-strength aluminum alloy, when the die-clamping pressure is maintained in the forming die, the dimensional accuracy of the formed part is improved while the stress relaxation occurs. On the premise of guaranteeing the quality of the formed part, a mode of the stepped aging treatment shortens the aging cycle and reduces energy consumption in the production and manufacturing process of the part.

The hot forming device for the large-size aircraft thin-walled part of high-strength aluminum alloy is further provided. It includes the environment heating furnace, the forming die, the temperature control unit, and the die-clamping force control unit. The environment heating furnace is configured to perform solution heat treatment on the blank; the temperature control unit and the die-clamping force control unit are respectively connected to the forming die to form the blank and perform the stepped aging treatment on the blank, thereby providing convenience for part forming, and reducing energy consumption for part forming.

BRIEF DESCRIPTION OF THE DRAWINGS

To describe the technical solutions in the embodiments of the present disclosure or in the prior art more clearly, the following briefly describes the accompanying drawings used in the embodiments. Apparently, the accompanying drawings in the following description show merely some embodiments of the present disclosure, and a person of ordinary skill in the art may still derive other drawings from these accompanying drawings without creative efforts.

Figure 1:
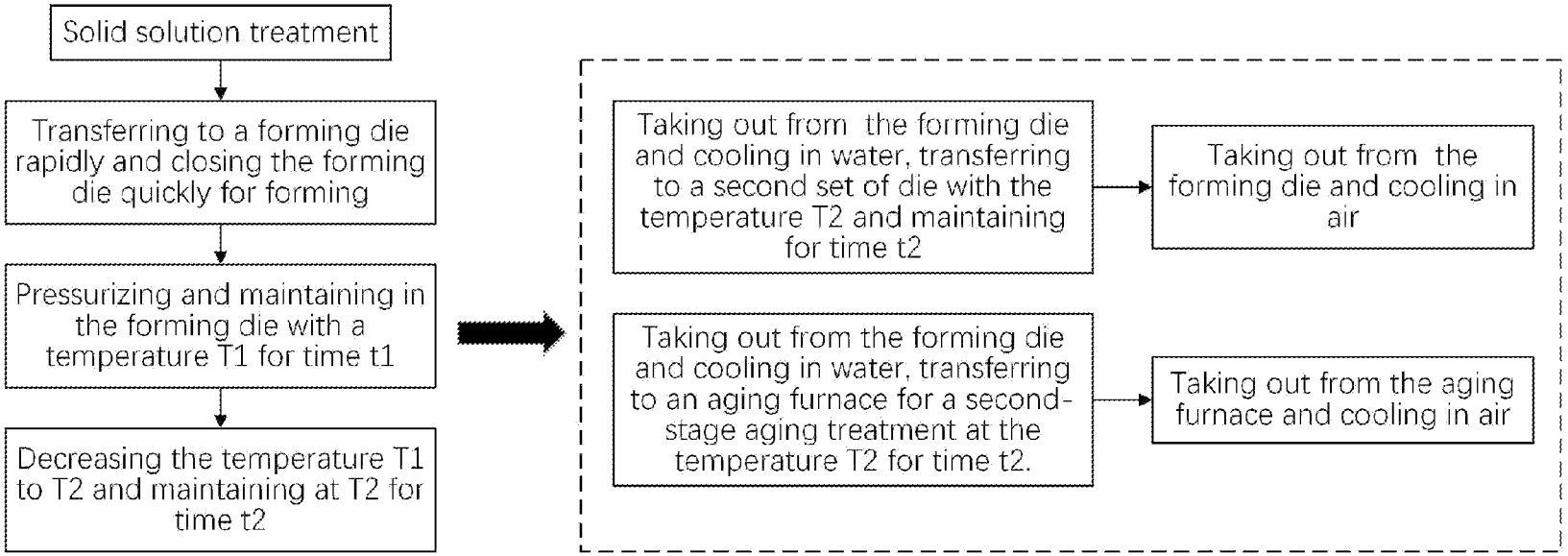
FIG. 1 is a flow diagram in an embodiment of a hot forming method for a large-size aircraft thin-walled part of high-strength aluminum alloy, according to the present disclosure.

Reference numerals: 1 environment heating furnace; 2 forming die; 201 upper die; 202 lower die; 203 blank holder; 204 sliding block, 205 platform; 206 insulating panel; 207 guide pillar; 3 temperature control unit; 301 heating element; 302 cooling channel; 4 die-clamping force control unit; 401 gas-liquid pressure cylinder; 5 blank.

DETAILED DESCRIPTION OF THE EMBODIMENTS

The following clearly and completely describes the technical solutions in the embodiments of the present disclosure with reference to the accompanying drawings in the embodiments of the present disclosure. Apparently, the described embodiments are merely a part rather than all of the embodiments of the present disclosure. All other embodiments obtained by a person of ordinary skill in the art based on the embodiments of the present disclosure without creative efforts shall fall within the protection scope of the present disclosure.

In the description of the present disclosure, the terms "a" or "an" as used herein, are defined as one or more than one, and it is to be understood that the terminology used herein is only for the purpose of describing particular embodiments and is not intended to be limiting.

An objective of the present disclosure is to provide a hot forming method and device for a large-size aircraft thin-walled part of high-strength aluminum alloy to solve the problems in the prior art, thereby reducing energy consumption for part forming, and improving accuracy of part forming.

To make the objectives, features and advantages of the present disclosure more apparent and understandable, the following further describes the present disclosure in detail with reference to the accompanying drawings and the specific embodiments.

Figure 2:
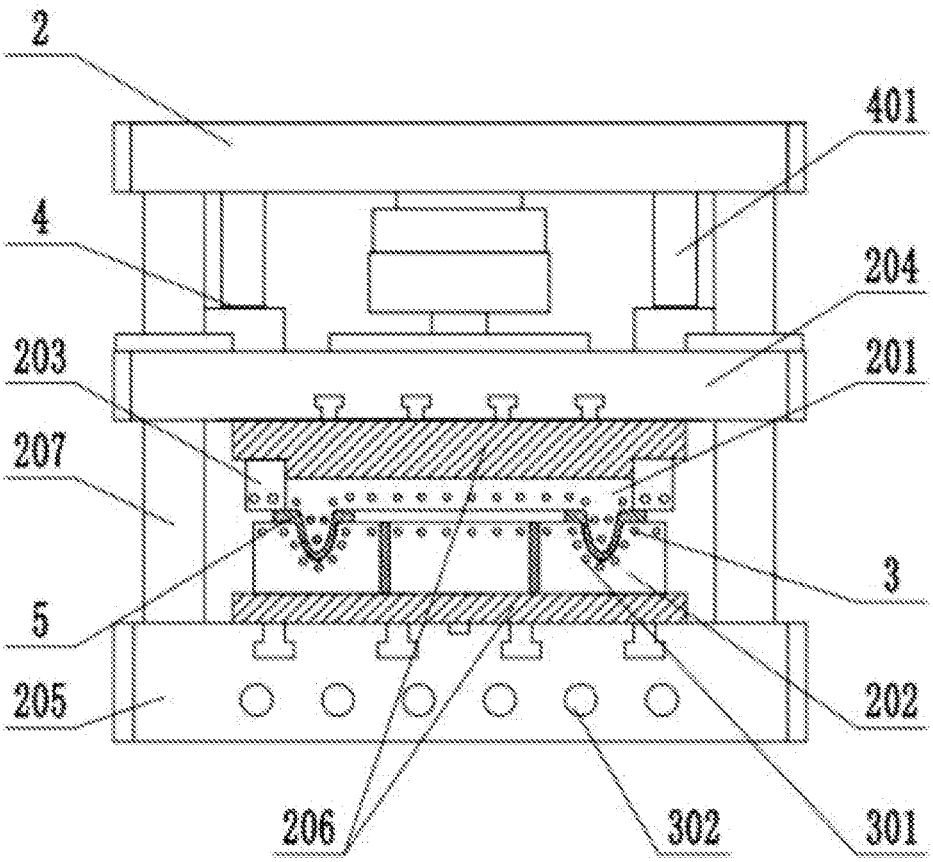
FIG. 2 is a schematic structural diagram of a forming die of a hot forming device for the large-size aircraft thin-walled part of high-strength aluminum alloy, according to the present disclosure.
Figure 3:
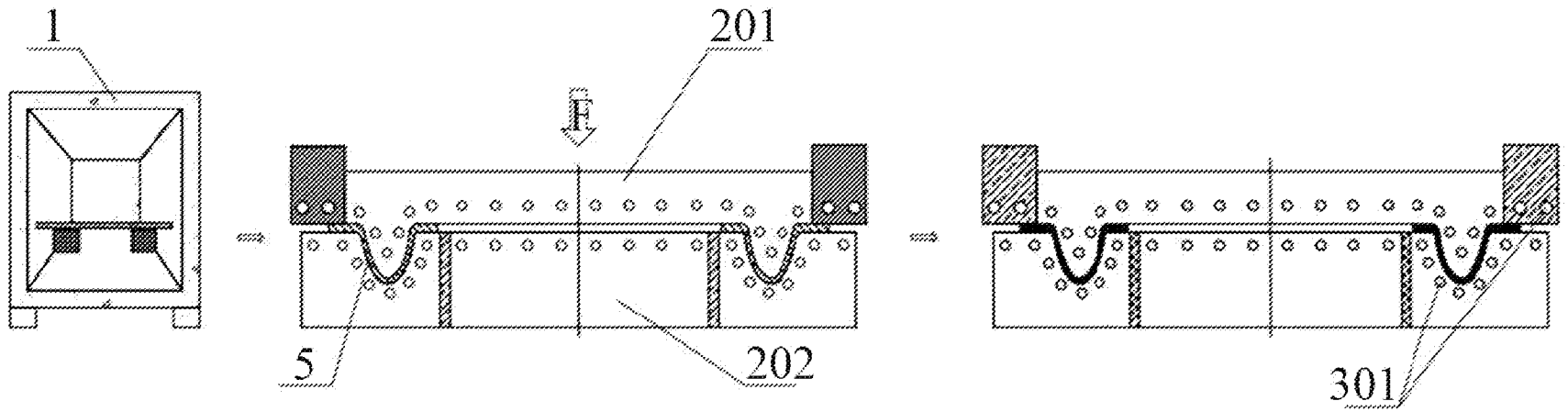
FIG. 3 is a schematic diagram showing an operation in an embodiment of the hot forming device for the large-size aircraft thin-walled part of high-strength aluminum alloy, according to the present disclosure.
Figure 4:
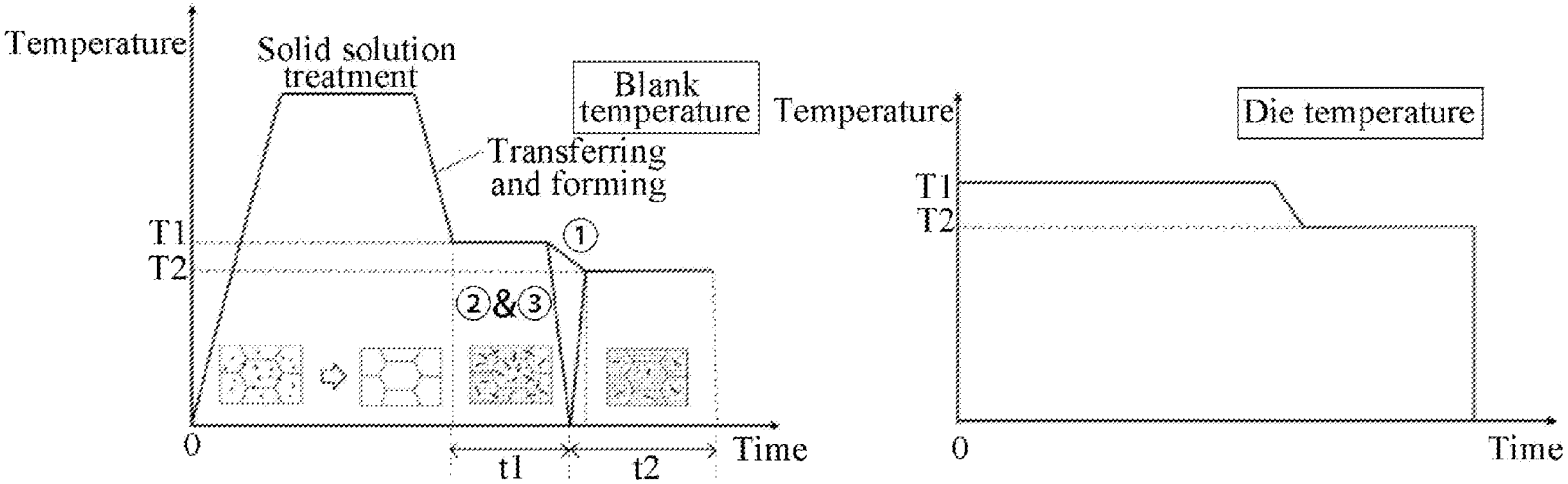
FIG. 4 is a schematic diagram showing microstructure evolution in a forming process in the implementation of the hot forming method for the large-size aircraft thin-walled part of high-strength aluminum alloy, according to the present disclosure.
Figure 5A:
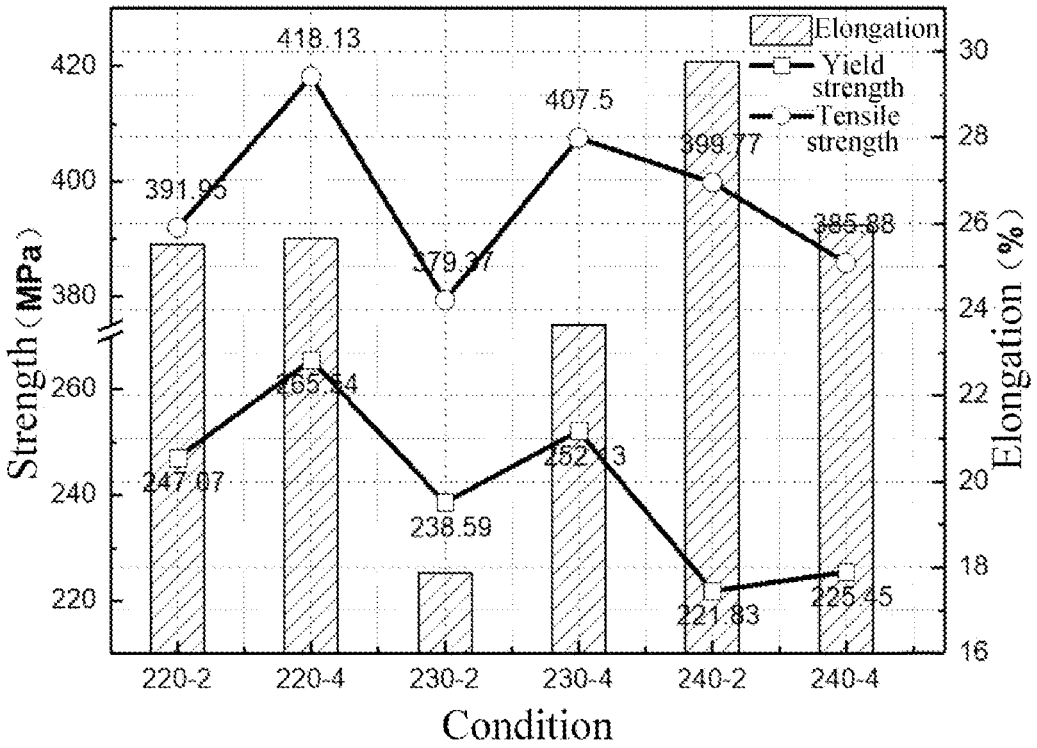
FIG. 5A and FIG. 5B are schematic diagrams showing strength results of a formed part in the implementation of the hot forming method for the large-size aircraft thin-walled part of high-strength aluminum alloy, according to the present disclosure.
Figure 5A:
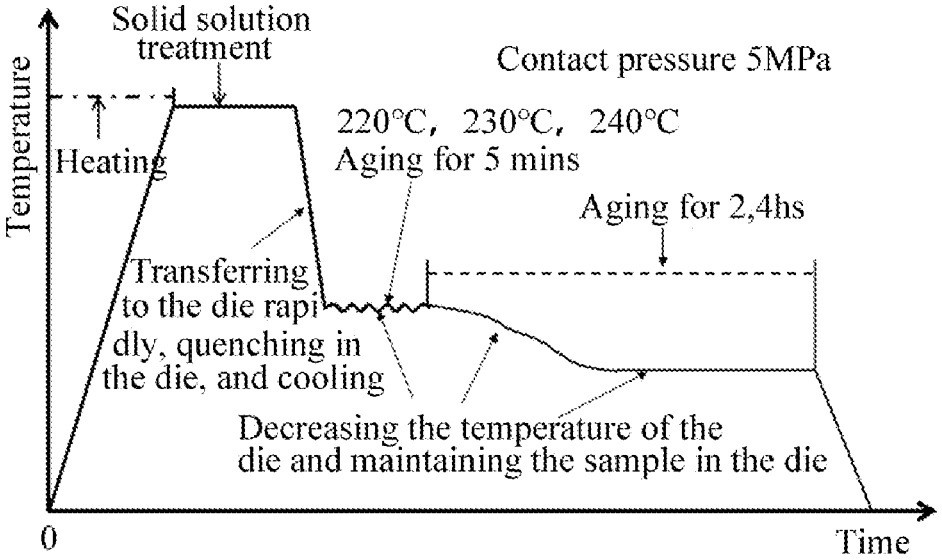
Figure 5B:
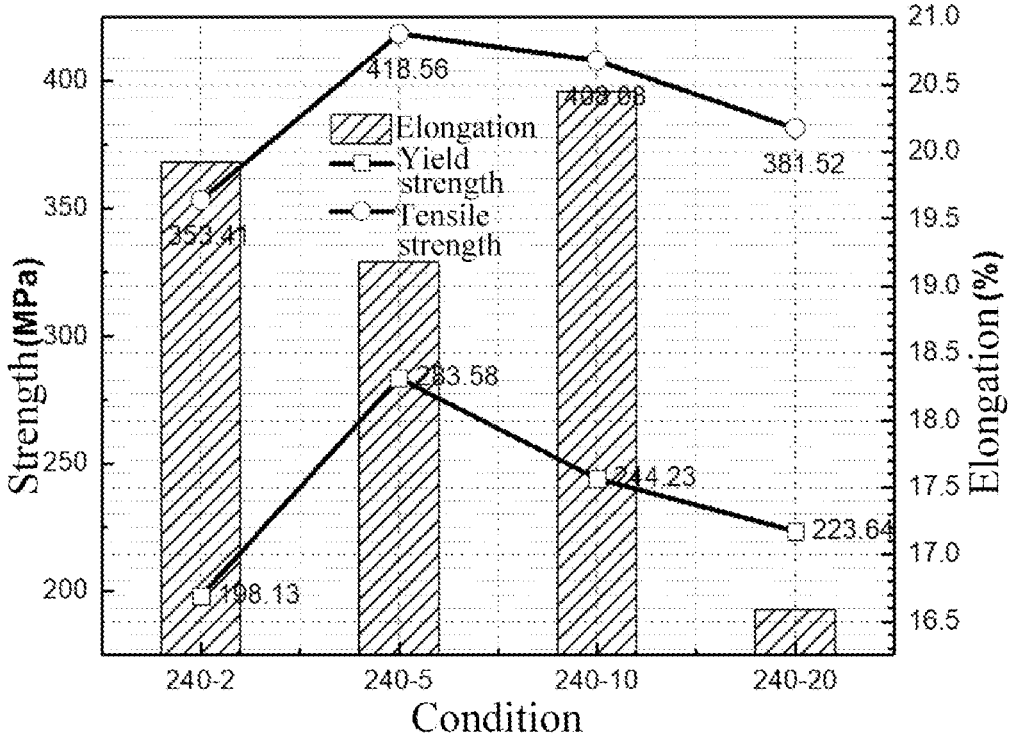
Figure 5B:
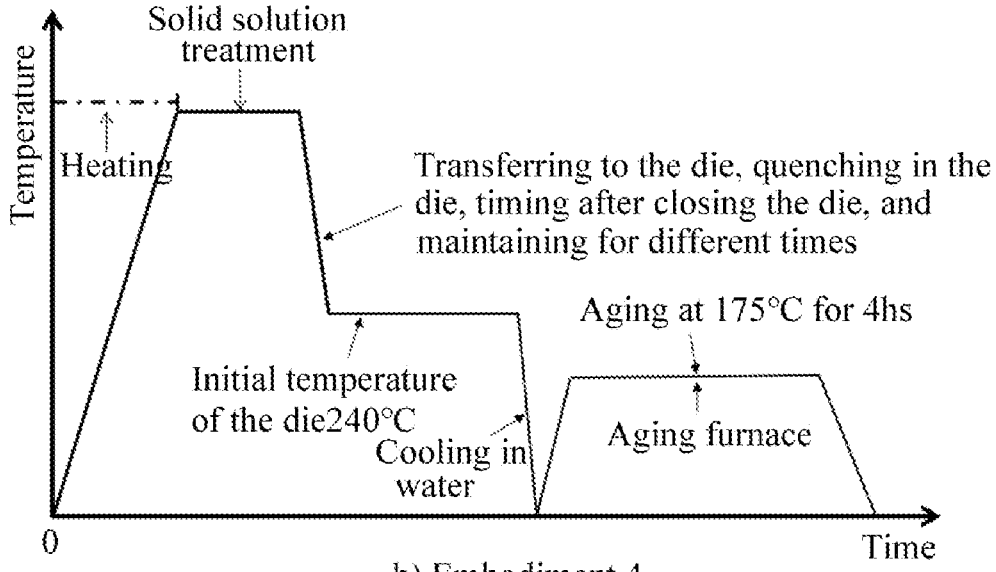

Referring to FIG. 1 to FIG. 5B, FIG. 1 is a flow diagram in an embodiment of a hot forming method for a large-size aircraft thin-walled part of high-strength aluminum alloy, according to the present disclosure; FIG. 2 is a schematic structural diagram of a forming die of a hot forming device for the large-size aircraft thin-walled part of high-strength aluminum alloy, according to the present disclosure; FIG. 3 is a schematic diagram showing an operation in an embodiment of the hot forming device for the large-size aircraft thin-walled part of high-strength aluminum alloy, according to the present disclosure; FIG. 4 is a schematic diagram showing micro-structure evolution in a forming process in the implementation of the hot forming method for the large-size aircraft thin-walled part of high-strength aluminum alloy, according to the present disclosure; and FIG. 5A and FIG. 5B are schematic diagrams showing strength results of a formed part in the implementation of the hot forming method for the large-size aircraft thin-walled part of high-strength aluminum alloy, according to the present disclosure.

A hot forming method for the large-size aircraft thin-walled part of high-strength aluminum alloy includes the following steps:

step one, performing solution heat treatment on a blank 5 to remove coarse precipitated phases, thus obtaining a uniform microstructure with excellent plasticity;

step two, transferring the blank 5 subjected to the solution heat treatment into a forming die 2 with a temperature of T1, gradually forming the blank 5 in a die-closing process, and increasing die-clamping force after closing of the die;

step three: maintaining a formed part in the forming die 2 at the temperature T1 for a period of time t1, where the formed part is subjected to a first-step aging treatment in the forming die 2 so that enough GP zone is formed in the formed part to create an ideal microstructure condition for a subsequent second-step aging treatment; and step four, cooling the temperature of the forming die 2 to T2, and performing the second-step aging treatment on the formed part for the time t2, where the formed part undergoes stress relaxation which eliminates residual stress in the formed part and ensures strength and dimensional accuracy of the formed part.

In the hot forming method for the large-size aircraft thin-walled part of high-strength aluminum alloy, firstly the solution heat treatment is performed on the blank 5 to dissolve the coarse secondary phases in an initial microstructure, to obtain a uniform solution heat microstructure; the blank 5 subjected to the solution heat treatment is transferred into the temperature-controllable forming die 2, the die is closed for forming and the die-clamping force is increased, and the temperature and the pressure are further maintained for a period of time; the temperature of the forming die 2 is adjusted to a second-step aging temperature for the second-step aging treatment where the pressure and the temperature are maintained. In a two-step aging temperature range, the stress relaxation occurs while strengthening phases are rapidly precipitated, thereby improving the strength and dimensional accuracy of the formed part. In accordance with the hot forming method for the large-size aircraft thin-walled part of high-strength aluminum alloy, the dimensional accuracy of the formed part is improved while the stress relaxation caused by maintaining the pressure in the hot forming die occurs; on the premise of guaranteeing the quality of the formed part, employing stepped aging treatment shortens the aging cycle and reduces energy consumption in the production and manufacturing process of the parts.

In the step one, the temperature for the solution heat treatment on the blank 5 is 500° C. to 550° C., and the time for the solution heat treatment is less than 50 minutes.

In the step two, the time for transferring the blank 5 subjected to the solution heat treatment into the forming die 2 is 3 seconds to 30 seconds, it is appropriate to transfer the blank 5 rapidly, and the temperature T1 is in a range of 180° C. to 270° C.

In the step three, the time t1 is 0 minute to 30 minutes, and the specific temperature maintenance time may be determined according to the shape and specification of the formed part.

Moreover, in the step four, the temperature T2 of the forming die 5 is 150° C. to 180° C., and the aging time t2 is 1 hour to 6 hours.

It is further noted that, prior to the step one, the blank 5 is an aluminum alloy blank to be subjected to heat treatment, and an original state of the blank is the O state.

Further, a hot forming device for the large-size aircraft thin-walled part of high-strength aluminum alloy is provided, including:

an environment heating furnace 1, configured to perform solution heat treatment on the blank 5;

a forming die 2, which includes an upper die 201, a lower die 202 and a blank holder 203, where the blank holder 203 is matched with the lower die 202 to compress the blank 5 tightly, and the blank 5 is formed when the upper die 201 and the lower die 202 are closed;

a temperature control unit 3, connected to the forming die 2 and configured to control the temperature of the forming die 2; and a die-clamping force control unit 4, connected to the forming die 2 and configured to control a pressure after the upper die 201 and the lower die 202 are closed.

The hot forming device for the large-size aircraft thin-walled part of high-strength aluminum alloy includes the environment heating furnace 1, the forming die 2, the temperature control unit 3, and the die-clamping force control unit 4. The environment heating furnace 1 is configured for performing the solution heat treatment on the blank 5; the temperature control unit 3 and the die-clamping force control unit 4 are respectively connected to the forming die 2 to form the blank 5 and perform the stepped aging treatment, thereby providing convenience for part forming, and reducing energy consumption for part forming.

Specifically, the forming die 2 further includes a sliding block 204 and a platform 205. The lower die 202 is arranged at a top of the platform 205, and the sliding block 204 is arranged in a slidable mode above the top of the platform 205. The upper die 201 is connected to the sliding block 204, and the sliding block 204 can drive the upper die 201 to reciprocate to complete closing and opening operations of the forming die. The sliding block 204 is connected to a driving element which drives the sliding block 204 to move to smoothly drive the upper die 201 to reciprocate, and the driving element may be selected as a motor. Insulating panels 206 are arranged between the sliding block 204 and the upper die 201, and between the lower die 202 and the platform 205, for reducing heat loss and preventing the temperature from affecting other components, thus prolonging the service life of the forming die 2.

More specifically, the temperature control unit 3 includes a heating element 301 and a cooling channel 302. The heating element 301 is arranged in the upper die 201 and the lower die 202 to heat the forming die 2 conveniently. The cooling channel 302 is formed in the platform 205 and is communicated with an external cooling medium, the cooling channel 302 is used to convey the cooling medium into the forming die 2, and the cooling medium exchanges heat with the forming die 2 in the circulation process to control the temperature of the forming die 2, and the cooling medium may be water at room temperature. Moreover, the die-clamping force control unit 4 includes a gas-liquid pressure cylinder 401 and a pressure control valve which are connected to each other. The gas-liquid pressure cylinder 401 is connected to the upper die 201 and is configured to increase pressure on the upper die 201; and after die closing, the gas-liquid pressure cylinder 401 increases the pressure on the upper die 201, and the quenching speed of the blank 5 in the forming die 2 is controlled by means of control of contact pressure.

In a specific embodiment of the present disclosure, a distance between the environment heating furnace 1 and the forming die 2 is 2 meters to 4 meters, which not only avoids mutual interference between two heat sources, but also avoids long transfer time due to the long distance. In other specific embodiments of the present disclosure, a die for the second-step aging treatment may be provided separately. In addition to this, as the time for cooling with the forming die is long, a temperature record starting point for the second-step aging treatment should be taken from beginning of the cooling.

The following further describes the hot forming method and device for the large-size aircraft thin-walled part of high-strength aluminum alloy through the specific embodiments.

Embodiment 1

FIG. 1 is a flow diagram of the hot forming method for the large-size aircraft thin-walled part of high-strength aluminum alloy in the embodiment, including the following steps.

Step 101: the blank 5 is subjected to solution heat treatment in the high-temperature heating furnace, where the temperature of the heating furnace 1 is heated to a solution heat temperature and then maintained for some time to uniformly distribute alloy elements in the aluminum matrix. The blank 5 may be a 2xxx series aluminum alloy, the temperature for the solution heat treatment should be 525° C. to 550° C., and the time for the solution heat treatment should be 25 minutes to 50 minutes; the blank 5 may be a 6xxx series aluminum alloy, the temperature for the solution heat treatment should be 500° C. to 580° C., and the time for the solution heat treatment should be 30 minutes to 45 minutes; the blank 5 may be a 7xxx series aluminum alloy, the temperature for the solution heat treatment should be 450° C. to 500° C., and the time for the solution heat treatment should be 40 minutes to 60 minutes; and a phenomenon that the structure is over-burnt due to excess temperature can be avoided.

Step 102: after the solution heat treatment, the blank 5 is rapidly transferred into the forming die 2 by means of a transferring tool, the forming die 2 is maintained at the temperature T1, and then the die is closed to increase the die-clamping force of the forming die 2 (with the pressure of 0.1 MPa to 10 MPa), so that quenching is performed in the forming die while the blank 5 is formed, and then the formed part is maintained at the temperature T1 for the time t1 after the blank 5 is formed.

Step 103: a heating power of the heating element 301 is controlled by the temperature control unit 3 to reduce the temperature T1 of the forming die 2 to a temperature T2, the formed part is not removed from the forming die 2, and the die-clamping pressure is guaranteed to perform the second-step aging treatment in the forming die.

Alternatively, the second-step aging treatment has the following process routes: (1) the formed part is taken out for rapid water cooling, and then is placed into an aging furnace for the second-step aging treatment; (2) the formed part is taken out for water cooling, and then is transferred into a second set of die with a predetermined temperature, in the second set of die the formed part is subjected to aging treatment while undergoing shape correction; (3) the formed part is not taken out, a temperature for the second-step aging treatment is set by the temperature control unit 3, so that the temperature of the forming die 2 is gradually decreased to the temperature for the second-state aging treatment, and then the second-step aging treatment is performed. In the flow diagram of the FIG. 1, the portion in a dotted frame shows optional process routes.

Embodiment 2

FIG. 2 is a schematic structural diagram of the forming die 2 of the hot forming device for the large-size aircraft thin-walled part of high-strength aluminum alloy, according to the embodiment. The hot forming device includes the forming die 2, the environment heating furnace 1 (high-temperature furnace at 650° C.), a transferring tool, the die heating rod, and the temperature control unit 3.

The forming die 2 includes the upper die 201, the lower die 202 and the blank holder 203. The upper die 201 can move up and down along a guide pillar 207. The upper die 201, the lower die 202 and insulating panels 206 are fixed to a die base by bolts. The upper die and the lower die are of H13 of hot-work die steel, while the die base is of 45 #steel. The upper die 201 and the lower die 202 each have a through heating hole, the heating rod is inserted into the heating hole, and then one end of the heating rod is connected to the temperature control unit 3. By utilizing thermometer holes of the upper die 201 and the lower die 202, temperature information is fed back to a temperature control box by means of a thermocouple connected to the temperature control box, and then the temperature of the forming die 2 is heated to the predetermined first-step aging temperature by means of the temperature control box, thus achieving the temperature regulation and control of the forming die 2. The insulating panels between the upper die 201, the lower die 202 and the die base have a fire-resistant limit of 1000° C., which can effectively reduce the heat loss.

The 650° C. high-temperature furnace, as a tool for the solution heat treatment and transferring, is mainly used for the solution heat treatment. The blank 5 is selected as a 2xxx series aluminum alloy, and has a thickness of 2 millimeters. Before using the high-temperature furnace which can be heated to 650° C., the temperature of the furnace is firstly calibrated, that is, the thermocouple is fixed to the blank 5, the time required for the blank 5 to reach the solution temperature and the actual temperature are recorded by a thermometer, and the temperature measured by the high-accuracy thermometer is taken as the standard. Then the process method at the solution heat treatment stage is developed. For the heating element 301, an outer layer of the heating rod is a stainless-steel tube, nickel chrome wire is provided in the heating rod, and magnesium powder is used as a filler. The heating limit temperature is 500° C., which is fully applicable for the first-step aging temperature from 200° C. to 265° C. A power of the heating rod is 2.4 kW, which is less than that of the temperature control box.

The temperature control box, as a core component of the temperature control unit 3, controls the heating rod for heat output and receives the temperature information fed back by the thermocouple, thereby preventing the temperature from exceeding the predetermined temperature.

Embodiment 3

Step 301: the blank 5 (2219 aluminum alloy plate) is placed into the environment heating furnace 1 for the solution heat treatment for 40 minutes at 535° C., and meanwhile, the forming die 2 is heated by the temperature control unit 3 and the heating element 301, so that the temperature of the forming die 2 reaches the first-step aging temperature.

Step 302: after completing the solution heat treatment, the blank 5 subjected to the solution heat treatment is transferred by the transfer facility, the transfer time should be controlled within 10 seconds as much as possible, thus preventing excessive heat dissipation and guaranteeing that the temperature during forming in the forming die 2 is higher than 450° C.

Step 303: after transferring to the forming die 2, the forming die is rapidly closed for forming and quenching in the forming die 2 at the first-step aging temperature 240° C. After the thin-walled part fits the forming die, due to the action of the heat conduction, the temperature of the formed part may be rapidly reduced to a temperature close to the first-step aging temperature, and after closing the forming die, the die-clamping force of the closed forming die is increased to 5 MPa and then maintained for 5 minutes, this is the first-step aging treatment.

Step 304: after completing the first-step aging treatment in the forming die 2, the temperature of the forming die 2 is regulated by the temperature control unit 3, so that the temperature of the forming die 2 is slowly reduced to the predetermined second-step aging temperature 175° C.

Step 305: the second-step aging treatment is then performed in the forming die 2 for 2 hours or 4 hours, the aging treatment results in that the springback of the formed part is reduced after being removed from the forming die, and the dimensional accuracy of the part is further ensured. The thin-walled part is cooled in air after the aging treatment is completed.

FIG. 5A shows the strength result of the experiment according to embodiment 3. It can be known that the tensile strength can reach 380 MPa or more when the experiment is carried out at three temperature gradients of 220° C., 230° C. and 240° C., while the strength is highest and an excellent elongation can be obtained when the first-step aging treatment is carried out at 220° C. for 5 minutes and the second-step aging treatment at 175° C. for 4 hours.

Embodiment 4

FIG. 3 is a schematic diagram showing operation of the hot forming device for the large-size aircraft thin-walled part of high-strength aluminum alloy, according to the embodiment. The embodiment provides the hot forming method for the large-size aircraft thin-walled part of high-strength aluminum alloy, including the following steps.

Step 401: the blank 5 (2219-O) is placed into the environment heating furnace 1 for the solution heat treatment, and two sets of dies (the forming die 2 in this embodiment includes two sets of dies) are heated by the temperature control unit 3 and the heating element 301 to respectively reach an aging temperature T1=240° C. and an aging temperature T2=175° C.

Step 402: after completing the solution heat treatment, the blank subjected to the solution heat treatment is transferred by the transfer facility, the transfer time should be controlled within 10 seconds as much as possible to avoid excessive heat dissipation and guarantee that the temperature during forming in the first die is higher than 450° C.

Step 403: after transferring to the first set of die, the first set of die is rapidly closed for forming and quenching at the predetermined die temperature. After the thin-walled part fits the die, the die-clamping force of the die is increased to 1.8 MPa, the temperature of the die may be rapidly reduced to a temperature close to the aging temperature of the first set of die, and after closing the die, the die is maintained at this temperature for a period of time, this is the first-step aging treatment.

Step 404: after completing the first-step aging treatment in the first set of die, the formed part is taken out and rapidly cooled by water, and after completing the water cooling, the formed part is dried, and then transferred to the second set of die.

Step 405: the second-step aging treatment is carried out for 4 hours in the second set of die, the thin-walled part is subjected to shape correction while it is subjected to strengthening by the aging treatment, so that the springback is eliminated, thereby ensuring the dimensional accuracy of the formed part. The thin-walled part is cooled in air after completing the aging treatment.

FIG. 5B shows the strength results caused by performing the stepped aging treatment in different dies, the strength of the formed part is increased as the first-step aging time increases, where the optimal first-step aging time is 5 minutes, and the strength of the formed part can reach less than the T6 strength (tensile strength 415 MPa and yield strength 290 MPa).

In conclusion, in accordance with the hot forming method and device for the large-size aircraft thin-walled part of high-strength aluminum alloy, the strengthening period of the aluminum alloy is shortened by quenching and aging in the die, where the variable temperature forming die 2 may simplify the process route and reduce the process equipment. In the aging treatment within the die after forming, due to existence of the die-clamping force, the die can perform creep deformation and shape correction on the formed part. After the die is closed, the cooling speed of the blank 5 can be controlled according to different contact pressure between the upper die 201 and the blank 5, so that a cooling curve of the blank 5 is avoided from encountering a TTT curve of quenching sensitivity, thereby reducing the strength loss of the final formed part. In this process, the springback caused by the traditional cold stamping can be effectively reduced, the process period can be shortened, and the dimensional accuracy can be improved.

Several examples are used for illustration of the principles and implementation methods of the present disclosure. The description of the embodiments is merely used to illustrate the method and its core principles of the present disclosure. In addition, a person of ordinary skill in the art can make various modifications in terms of specific embodiments and scope of application in accordance with the teachings of the present disclosure. In conclusion, the content of this specification shall not be construed as a limitation to the present disclosure.

What is claimed is:

1. A hot forming method for an aluminum alloy aircraft part, comprising following steps:

solution heat treatment step, configured for performing solution heat treatment on a blank, wherein a temperature for the solution heat treatment on the blank is 500° C.-550° C.;

forming and in-die quenching step, configured for transferring the blank subjected to the solution heat treatment into a forming die with a temperature of T1, forming the blank during closing of the forming die, and quenching in the forming die after forming of the forming die, wherein the temperature T1 is in a range of 180° C. to 270° C.;

first-step aging step, configured for maintaining a formed part at the temperature T1 for time t1 after the blank is formed, wherein the formed part is subjected to a first-step aging treatment in the forming die, wherein the time t1 is equal to 30 minutes; and second-step aging step, cooling a temperature of the forming die to a temperature T2, and further performing a second-step aging treatment for time t2, wherein the temperature T2 of the forming die is 150° C.-180° C., and the time t2 for the second-step aging treatment is 1 hour to 6 hours.

2. The hot forming method according to claim 1, wherein in the solution heat treatment step, time for the solution heat treatment is greater than 0 minutes and less than 50 minutes.

3. The hot forming method according to claim 1, wherein in the forming and in-die quenching step, time for transferring the blank subjected to the solution heat treatment into the forming die is 3 seconds to 30 seconds.

4. The hot forming method according to claim 1, wherein prior to the solution heat treatment step, the blank is an aluminum alloy blank to be subjected to heat treatment, and the blank is in a T state, an H state, or an O state.

* * * * *